United States Patent [19]

Buraas

[11] 4,329,952

[45] May 18, 1982

[54] OIL CONTROL SYSTEM FOR PISTON-TYPE AIRPLANE ENGINES

[76] Inventor: Vincent S. Buraas, Box 176, Northwood, N. Dak. 58267

[21] Appl. No.: 113,491

[22] Filed: Jan. 21, 1980

[51] Int. Cl.[3] ..... F01M 1/00

[52] U.S. Cl. ..... 123/196 AB; 123/142.5 R

[58] Field of Search ..... 123/196 AB, 196 R, 142.5 R; 184/6.21, 6.22, 6.5; 60/39.08

[56] References Cited

U.S. PATENT DOCUMENTS

| | | | |
|---|---|---|---|
| 2,268,653 | 1/1942 | Flowers | 184/6.21 |
| 2,311,069 | 2/1943 | Miller | 123/196 AB |
| 2,433,420 | 12/1947 | Booth | 123/196 AB |
| 2,614,575 | 10/1952 | Jensen | 123/196 AB |

*Primary Examiner*—Charles J. Myhre
*Assistant Examiner*—E. Rollins Cross
*Attorney, Agent, or Firm*—Peterson, Palmatier, Sturm & Sjoquist

[57] ABSTRACT

A manually-operated valve is associated with the oil tank of an airplane's lubrication system so that oil can be circulated directly from the oil outlet of the engine to the oil inlet of the engine until the oil becomes warm. The manually-operated valve can then be repositioned so as to mix oil from the oil outlet of the engine with the oil contained in the oil tank, then supplying the mixed oil to the inlet of the engine. Provision is also made for directing oil from the oil outlet of the engine to the manually-operated valve after it has been cooled by the oil cooler, the mixing action then being achieved with the cooled oil.

10 Claims, 1 Drawing Figure

OIL CONTROL SYSTEM FOR PISTON-TYPE AIRPLANE ENGINES

BACKGROUND OF THE INVENTION

1. Field of the Invention

This invention relates generally to oil lubricating systems for aircraft engines, and pertains more particularly to a system for achieving a rapid warm-up of the oil in just a short interval after a cold engine has been started.

2. Description of the Prior Art

In oil lubricating systems for piston-type aircraft engines, it is customary to have a main oil tank installed from which the oil is gravitationally delivered to the engine, the oil then being returned from the engine to the tank for reuse. Thus, the oil continually circulates through the tank. After a period of time, the oil becomes warm and it is also conventional to make use of an oil cooler or radiator so that some or all of the oil can be passed through the cooler in order to prevent the oil temperature from becoming too hot.

However, especially in northern climates, small propeller-operated aircraft experience extremely low temperatures with the consequence that the internal combustion engine, and also the oil within the lubricating system, becomes quite cold and viscous. To reduce the degree of viscosity, it has been quite common to introduce into the oil a suitable diluent, such as alcohol, so that the combined liquid can flow more readily. As the lubricant containing the diluent becomes heated, then the diluent, especially if it is an alcohol and therefore volatile, vaporizes, thereby ultimately leaving the oil in virtually the same condition as it was originally. While procedures such as this have produced generally acceptable results, it is a nuisance for the pilot to be concerned with the adding of a diluent and, quite obviously, he must not introduce too much. Also, care must be exercised not to introduce too much at a given time, it being necessary to control the rate of adding the diluent. Also, the adding of diluent must be discontinued at the appropriate time, and sometimes this delays takeoff, and if provision is made for discontinuing the adding of a diluent after takeoff, the system becomes rather complex and quite costly.

SUMMARY OF THE INVENTION

Accordingly, an important object of the present invention is to provide for a quick warm-up of the oil in a conventional lubricating system for aircraft, doing so without adding any diluent.

Another object of my invention is to provide a system of the foregoing character in which the oil, without any diluent, can be circulated directly from the oil outlet of the internal combustion back to the oil inlet thereof, and after the oil has reached the proper operating temperature, the pilot, whether on the ground or in the air, can then cause some of the oil to be diverted from the main oil tank and mixed with the oil returning to the engine.

Also, the invention has for an object the cooling of oil, as well as the mixing thereof, in order to prevent the oil from reaching an excessively high temperature at any time.

Yet another object is to provide an oil control system that will be exceedingly reliable and literally failsafe, and also one that can make use of appropriate indicating lights so that the pilot is always apprised of the mode of operation.

Still a further object is to provide a simple and inexpensive oil temperature control system for aircraft, particularly those of the propeller type, which can be readily incorporated into the lubricating systems of airplanes already in existence. In other words, my invention lends itself readily to use with aircraft of various types that are already in use, the invention in no way being restricted to factory installation on new craft.

Briefly, as far as my invention is concerned, the main oil tank of an airplane is modified so as to have incorporated therein an auxiliary oil tank and also a manually-operable valve so that oil can be passed directly through the main oil tank to the inlet of the internal combustion engine and constantly recirculated without blending the oil with the oil contained in the main tank. This permits the oil when cold to be quickly warmed. Once the oil is sufficiently hot, then the changing of the valve to another position causes some of the oil from the main tank to be mixed with the oil coming from the outlet of the engine and the temperature of the oil in this way controlled. On the other hand, if cooling of the oil becomes necessary, then another valve permits the oil to be directed through an oil cooler and then through the auxiliary tank and the mixing valve associated therewith.

BRIEF DESCRIPTION OF THE DRAWING

The sole FIGURE selected to exemplify my invention is a somewhat diagrammatic representation of one form thereof.

DESCRIPTION OF THE PREFERRED EMBODIMENT

Figure 1:
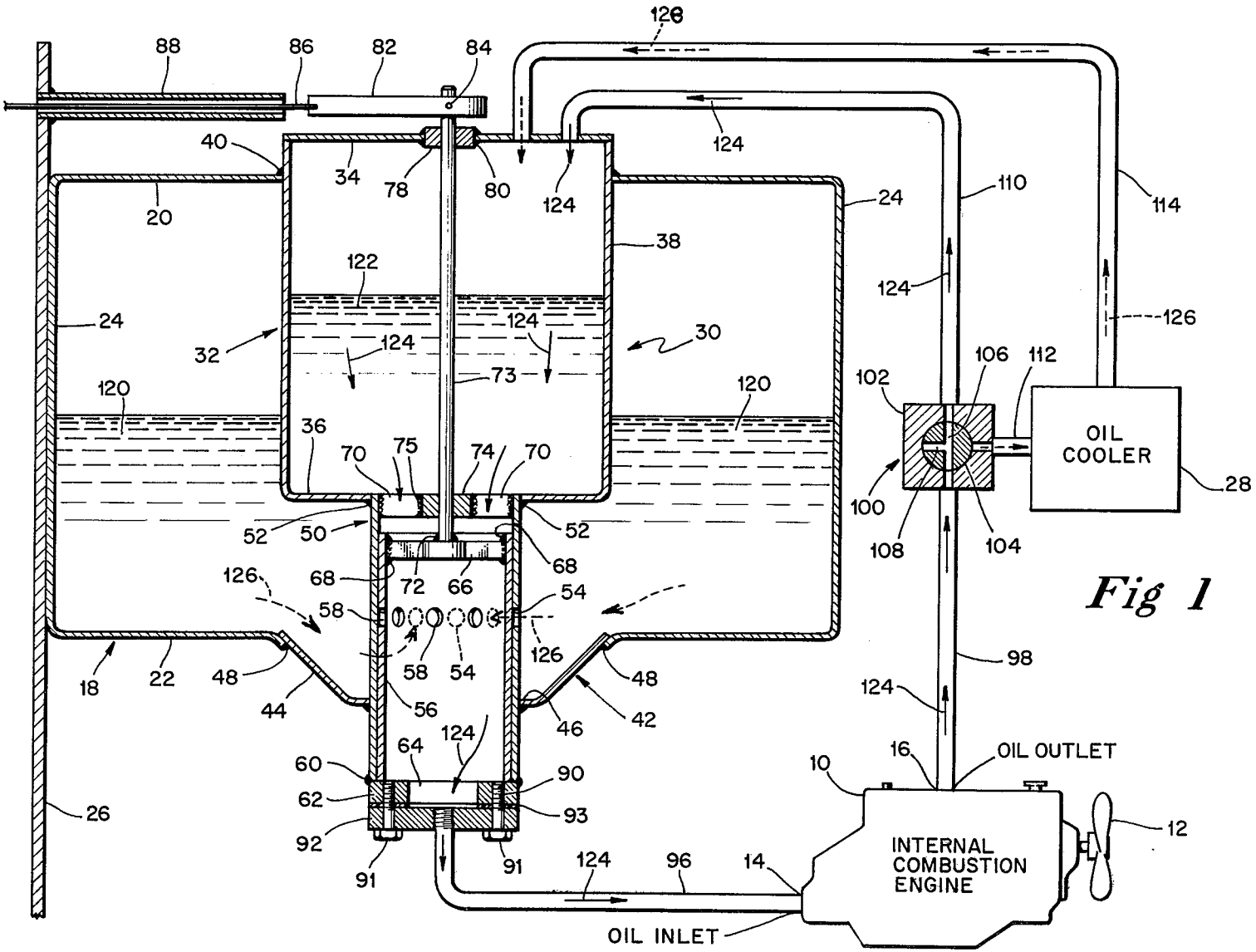

It is not believed necessary to depict a complete airplane. Therefore, only certain conventional components will be referred to. With this in mind, it will be observed that an internal combustion engine 10 has a propeller 12. Also, the engine 10 has an oil inlet at 14 and an oil outlet at 16.

As already stated, the single FIGURE illustrating my invention is somewhat diagrammatic; therefore, the size of the main oil tank labeled 18 is not of a size proportional to the engine 10. The tank 18 includes a top wall 20, a bottom wall 22 and four side walls 24. For the sake of drawing compactness, the tank 18 is secured in a proximal relation to the fire wall 26 of the aircraft, the cockpit being to the left of the fire wall 26 but not illustrated.

It is also conventional to cool the lubricating oil and therefore an oil cooler 28 has been shown in block form.

While some of the hydraulic hoses are for all intents and purposes similar to those in use as far as conventional lubricating installations are concerned, it will simplify the ensuing description to regard them as new and different, so they will be described in conjunction with the description of the apparatus indicated generally by the reference numeral 30 which exemplifies my invention. It should be borne in mind, though, that the principal object of my invention is to warm the oil rapidly and the apparatus 30 which accomplishes this will now be referred to in detail.

Accordingly, the apparatus 30 includes what will be termed a small or auxiliary oil tank 32 having a top wall 34, a bottom wall 36 and a cylindrical side wall 38. The upper portion of the cylindrical side wall 38 is seam welded at 40 to the top wall 20 of the main oil tank 18, an appropriately sized opening being cut in the top wall 20 so as to accommodate the auxiliary tank 32.

Adjacent the bottom of the tank 18 is a sump or tray 42 having a frusto-conical side wall 44 welded at 46 to a member and presently to be referred to welded at 48 to the bottom wall 22 of the main tank 18, an appropriately sized opening being first cut in the bottom wall 22.

From the foregoing, it will be appreciated that the main oil tank 18, which is of conventional construction, has been modified by adding the parts 32 and 42, the welds 40 and 48 rendering the top and bottom fluid tight.

Depending downwardly from the bottom wall 36 of the auxiliary tank 32 is a tubular casing or housing 50, the upper end of which is secured to the bottom wall 36 by a weld at 52 and to the wall 44 of the tray 42 by the weld 46. For a purpose presently to be made manifest, the tubular casing or housing 50 is formed with a series of ports or openings 54, these being annularly spaced completely around the casing 50; one of the openings 54 appears in solid outline, whereas the other openings 54 are concealed by a member now to be referred to and therefore are indicated in dotted outline.

Rotatably positioned within the tubular casing 50 is a tubular liner 56 having ports or openings 58 which are registrable with the ports or openings 54.

The lower end of the tubular casing or housing 50 has welded thereto at 60 a circular flange or ring 62 having a central opening 64 therein. In this way, the lower end of the tubular liner 56 is supported on the upper surface or face of the ring 62. Also, the ring 62 maintains the ports or openings 58 of the liner 56 at the same height or elevation so that when the tubular liner 56 is rotated within the tubular casing or housing 50, the ports 58 thereof can be brought into alignment with the ports 54.

Attention is drawn at this time to the means by which the tubular liner 56 can be rotated sufficiently to effect alignment of the ports 58 with the ports 54. In the accomplishment of this aim, a bridging strip 66 has its ends welded at 68 to the inner surface of the tubular liner 56. It is important to keep in mind that the strip 66 does not block the upper end of the liner 56, since it is intended that oil flow downwardly through the liner 56 as will presently be described. It might be also pointed out at this time that the bottom wall 36 of the auxiliary tank 32 has an opening 70 therein so as to not impede the downward flow of oil, all as will be more fully explained as the description proceeds.

The bridging strip 66 has welded thereto at 72 the lower end of a vertical rod 73. The vertical rod 73 extends upwardly through a lower bushing 74 welded at 75 to the inner ends of spoke-like strips 76, the outer ends of the strips 76 being welded at 77 to the inside of the upper end of the casing 50. It can be pointed out that the horizontal width of the strips 76 need be no greater than the diameter of the rod 73, thereby providing ample space between the strips 76 and the casing 50 for the flow of oil in the same manner as that permitted by the strip 66. An upper bushing 78 is welded at 80 to the top wall 34 of the auxiliary tank 32.

The upper end of the rod 73 has a lever arm 82 attached thereto, as by a pin 84. While the arm 82 appears to be in the plane of the paper, it in practice would be at an angle either away from the viewer or toward the viewer. In this way, an actuating cable 86 extending through a guide tube 88 projecting from the fire wall 26 can be used to swing the arm 82 into either of two angular positions, one of which is pictured and which causes the ports 54 and 58 to be out of registry, the other angular position of the arm 82 causing the ports 54 and 58 to become aligned or registered. Suitable stops (not shown) serve as limits for these two angular positions of the arm 82. Also, it will be recognized that appropriate microswitches (not shown) can be utilized so as to effect the energization of indicating lights (also not shown) which signify the angular position of the arm 82 and hence the unregistered or registered condition, as the case may be, of the ports 54 and 58. When appropriate indicating lamps are employed in the cockpit, appropriate conductors leading thereto, the pilot is always visually apprised of the position in which he has manually moved the arm 82 via the cable 86.

The ring 62, which functions as an inwardly directed flange, is tapped at 90 for the accommodation of four screws or bolts 91, although only two appear in the drawing. The screws 91 extend upwardly through an annular bottom plate 92. A gasket 93 is sandwiched between the ring 62 and plate 92 to provide a liquid tight seal. The plate 92 has a centrally tapped opening or outlet 94, so that oil flowing downwardly may pass therethrough.

As previously mentioned, some of the hydraulic hoses utilized in the practicing of my invention are conventional. Nonetheless, since some modification of parts associated with the hoses now to be described has been made, the hoses will be treated as new and different components. With this in mind, it will be perceived that a first hose 96 connects the opening or outlet 94 to the oil inlet 14 of the internal combustion engine 10. A second hose 98 connects the oil outlet of the engine 10 to a three-way valve 100.

For the sake of drafting simplicity, the valve 100 has been shown as being of the rotary spool type. Accordingly, it includes a housing or casing 102 having a rotatable spool 104 therein. The spool 104 has a first passage 106 extending completely therethrough and a second passage 108 extending at right angles to the passage 106. In the position of the rotary spool 104, as shown, the passage 106 leads directly to a third hose labeled 110, the hose 110 extending from the valve 100 to the top of the auxiliary tank 32 so that oil flowing through the hose 110 is directed into the auxiliary tank 32.

Still another hose 112 extends from the valve 100 to the previously-mentioned oil cooler 28. When the spool 104 is rotated through 90° in a counterclockwise direction, it follows that the passage 108 is in registry with the hose 98 and one end of the passage 106 then connects the passage 108 to the hose 112 so that oil is directed to and through the oil cooler 28. The oil from the cooler 28 flows through a hose 114 which also leads into the upper end of the auxiliary tank 32. Hereagain, appropriate microswitches (not shown) can be employed for energizing cockpit indicating lights (also not shown) which signal to the pilot the rotation position of the valve spool 104 and have the flow path of the oil through the valve 100.

OPERATION

Assuming that the oil 120 contained in the main oil tank or reservoir 18 is cold and quite viscous, the pilot would position the arm 82 via the cable 86 so as to cause the ports 54 and 58 to be out of registry as pictured in the drawing. Consequently, the residual oil 122 contained in the auxiliary tank 32, as well as that remaining in the various hydraulic hoses 96, 98 and 110, is of a congealed nature and with the arm 82 positioned so as to cause the ports 54 and 58 to be out of registry, it follows that the oil traverses a direct path from the oil outlet 16 of the engine 10 upwardly through the hose 98, the valve 100, the hose 110, downwardly through the tank 32, the tubular liner 56, the bottom plate 92 and then through the hose 96 leading back to the inlet 14. Stated somewhat differently, the ports 54 and 58 are closed and no oil is transferred from the flow path just mentioned into the main tank 18.

It might be helpful to apply solid arrows 124 denoting the path that has just been referred to.

However, when the oil comes up to its proper operating temperature, being no longer viscous as it is when it is cold, the pilot via a thermal indicator (not shown) knows of the temperature and he can then operate the cable 86 so as to actuate the arm 82, moving it into its other angled position so that the ports 58 are in registry with the ports 54. At this time, it will be assumed that the position of the rotary spool 104 of the valve 100 has not been changed. What changes, though, is the path taken by the oil. Previously, all of a limited quantity of oil was circulated through the engine 10 in order to achieve a rapid warming or heating thereof. Now, though, some of the oil from the main tank 18 is permitted to enter the tubular liner 56 via the mated or lined ports 54, 58, doing so through the annular space provided by the sump or tray 42. It will be beneficial to apply dashed arrows 126 to show the mixing path taken by the oil under these adjusted conditions. It can be explained also that there is a transfer of heat from the oil during the initial operation when the oil is cold via the upper portion of the tubular casing or housing 50 that is in direct contact with the oil 120 contained in the main tank 18. Therefore, there has been a somewhat gradual warming of the oil 120 during the initial operation of the engine 10, but this is rather minimal, yet still a worthwhile accomplishment.

It should be taken into account that the size of the main oil tank 18 is quite large with respect to the volume of the small or auxiliary tank 122. Consequently, the rather large mass of the principal oil 120 serves as sort of a heat sink for the overall system, being rather slowly warmed as far as its complete mass is concerned. This provides a stabilizing thermal action.

However, when the oil 120 does reach too high a temperature, then some cooling must be resorted to. It is at this point that the valve 100 is operated so as to align the passage 108 with the hose 98 so that oil flows upwardly and then through the now horizontal passage 106 leading to the right into the hose 112 with the result that the oil flows through the cooler 28. Although this path is believed obvious, it will do no harm to superimpose dotted arrows 128 on the system which will indicate the path traversed by the cooled oil. It will be noted that the cooled oil, as indicated by the arrows 128, flows into the auxiliary tank 32 through the agency of the hose 114 and is blended with whatever oil 122 already present in the tank 32. It will be appreciated that the valve 100 has been described as a three-position valve; in actual practice, a valve would be employed that would permit partial communication and hence a partial bypassing of the oil through the cooler 28 so that the most satisfactory temperature can be realized for the oil.

In view of the foregoing description, it should be evident that my system is indeed quite versatile. When the oil is quite cold, the oil can be rapidly heated by directly recirculating the limited amount of oil through the internal combustion engine 10. Yet, when the temperature reaches a normal operating level, the oil can be mixed with some of the greater quantity of oil 120 so that the normal temperature can be maintained. While the arm 82 has been described as being movable into either of two positions, it will be obvious that in between positions can be resorted to so that only a partial registry of the ports 54, 58 is realized, this enabling a partial mixing of the limited supply of oil 122 with a lesser amount of the more massive supply of oil 120. Still further, when cooling is needed, my system permits the oil cooler to be brought into the hydraulic circuitry and whatever amount of cooling is needed can be achieved.

I claim:

1. In combination with an internal combustion engine having an oil inlet and an oil outlet, a main oil tank, and valve means associated with said tank for passing oil from said oil outlet directly to said oil inlet in a first selected position of said valve means without mixing said oil from said oil outlet with oil from said main tank, and for mixing oil from said oil outlet with oil from said main tank in a second selected position of said valve means.

2. The combination of claim 1 including an oil cooler, and second valve means for passing at least some of the oil from said oil outlet directly to said first valve means when said first valve means is in its said first selected position and also for passing at least some of the oil from said oil outlet to said first valve means when said first valve means is in its said second selected position.

3. The combination of claim 1 including an auxiliary oil tank, the oil passing through said first valve means also flowing through said auxiliary tank.

4. The combination of claim 3 including an oil cooler, and second valve means for passing oil from said oil outlet directly to said auxiliary tank and hence to said first valve means in a first selected position and for passing at least some of the oil from said oil outlet to said auxiliary tank in a second selected position.

5. In combination with an internal combustion engine having an oil inlet and an oil outlet, a main oil tank having top and bottom walls, an auxiliary tank within said main tank having a top wall projecting above the top wall of said main tank, the bottom wall of said auxiliary tank being at an elevation within said main tank above the bottom wall of said main tank, a tubular casing extending downwardly through the bottom wall of said main oil tank, a tubular liner rotatably disposed within said tubular casing, said tubular casing and tubular liner having ports that are out of registry with each other when said liner is in one rotative position and in registry when said liner is in a second rotative position, a hose connecting the lower end of said tubular casing to said oil inlet, and a hose connecting said oil outlet to the top of said auxiliary tank.

6. The combination of claim 5 including a sump encircling said tubular casing so that oil can pass through said ports from said main oil tank when in registry with each other when said tubular liner is in said second rotative position.

7. The combination of claim 5 including a valve between said oil inlet and the upper end of said auxiliary tank for directing oil from said oil outlet to said auxiliary tank when in a first position, and an oil cooler, said valve directing oil through said oil cooler to the upper end of said auxiliary tank when said valve is in a second position.

8. In combination with an internal combustion engine having an oil inlet and an oil outlet, a main oil tank, an auxiliary oil tank having a portion thereof within said main oil tank, casing means having a portion thereof within said main tank and having communication with said auxiliary tank and also having communication with said main tank, first hose means connected between said oil outlet and said auxiliary tank, second hose means connected between said casing and said oil inlet, and valve means for controlling the amount of communication between said main tank and said casing, said valve means in a closed position preventing flow of oil from said main tank into said casing and thereby preventing the mixing of oil from said main tank with oil flowing from said auxiliary tank into said casing and in an open position permitting flow of oil from said main tank into said casing and thereby causing mixing of oil from said main tank with oil flowing from said auxiliary tank into said casing.

9. The combination of claim 8 in which said casing is cylindrical and said communication with said main tank is via angularly disposed openings in said casing, said valve means including a tubular liner having angularly disposed openings movable out of registry with said openings in said cylindrical casing to provide said closed position and movable out of registry to provide said open position, said tubular liner also being movable to intermediate position to effect a partial mixing of oil from said main tank with oil flowing from said auxiliary tank into said casing.

10. The combination of claim 8 including means for operating said valve means between its said closed and open positions from a remote vantage point.

* * * * *